US005672068A

United States Patent [19]

Tsuchiya et al.

[11] Patent Number: 5,672,068

[45] Date of Patent: Sep. 30, 1997

[54] LEVER-JOINT TYPE CONNECTING STRUCTURE

[75] Inventors: Shinichi Tsuchiya; Shigeo Mori, both of Shizuoka-ken, Japan

[73] Assignee: Yazaki Corporation, Tokyo, Japan

[21] Appl. No.: 609,243

[22] Filed: Mar. 1, 1996

[30] Foreign Application Priority Data

Mar. 3, 1995 [JP] Japan ..... 7-043852

[51] Int. Cl.[6] ..... H01R 13/62

[52] U.S. Cl. ..... 439/157; 439/489

[58] Field of Search ..... 439/152–160, 439/489

[56] References Cited

U.S. PATENT DOCUMENTS

| | | | |
|---|---|---|---|
| 5,320,544 | 6/1994 | Taguchi et al. | 439/157 |
| 5,322,383 | 6/1994 | Saito et al. | 439/157 |
| 5,328,377 | 7/1994 | Saito | 439/157 |
| 5,427,540 | 6/1995 | Taguchi | 439/157 |
| 5,474,462 | 12/1995 | Yamanashi | 439/157 |
| 5,476,390 | 12/1995 | Taguchi et al. | 439/157 |
| 5,513,997 | 5/1996 | Taguchi et al. | 439/157 |

FOREIGN PATENT DOCUMENTS 2-278674 11/1990 Japan .

*Primary Examiner*—Neil Abrams
*Assistant Examiner*—Brian J. Biggi
*Attorney, Agent, or Firm*—Wigman, Cohen, Leitner & Myers, P.C.

[57] ABSTRACT

A connecting structure in which a male connector can be fitted into a female connector by operating a joint lever is provided. The joint lever is rotatably attached to either the male connector or the female connector. The connecting structure further includes projections to be inserted into the guide grooves and a fit detecting member for detecting the fitting condition between the male connector and the female connector. In fitting the male connector into the female connector, the fit detecting member is released from its engaged condition in the temporary engagement position by rotation of the joint lever. In the case where the fit detecting member is engaged in the formal engagement position, the fit detecting member operates to prevent the joint lever from being rotated.

14 Claims, 6 Drawing Sheets

LEVER-JOINT TYPE CONNECTING STRUCTURE

BACKGROUND OF THE INVENTION

1. Technical Field

The present invention relates to a connecting structure in which a male connector can be connected with a female connector by operating a joint lever. Such a connecting structure will be referred to hereinafter as "a lever-joint type connecting structure."

2. Description of the Related Art

In prior art, Japanese Unexamined Patent Publication (Kokai) No. 2-278674 discloses a lever-joint type connecting structure consisting of a male connector and a female connector having a fitting hood part into which the male connector is to be fitted. In the lever-joint type connecting structure, a substantial C-shaped joint lever is rotatably supported on the female connector so as to straddle the fitting hood part. The joint lever has a pair of arc guide grooves formed to extend along the rotating direction of the joint lever while, the male connector has a pair of pins formed to project from the outer periphery of the male connector laterally. In operation, when the male connector is connected to the female connector, the pins are inserted into respective guide grooves of the joint lever.

The male connector is provided with a locking arm for fixing the inserted male connector on the female connector. On the other hand, the female connector has an engagement recess formed so as to engage with an engagement projection formed at the tip of the locking arm.

The operation of the above-mentioned conventional connecting structure will now be described in brief.

In connecting the male connector with the female connector, the male connector is firstly inserted up to the halfway point of the fitting hood of the female connector. Next, the joint lever is rotated so that the pair of pins are respectively inserted into the arc guide grooves. With a further rotation of the joint lever, the pair of pins are inserted into the inmost parts of the guide grooves, being guided by the grooves. When the pins are brought into contact with the inmost parts of the guide grooves, the male connector is fitted into the fitting hood part of the female connector completely and, thereafter, the engagement projection of the locking arm is engaged into the engagement recess, providing complete connection between the male connector and the female connector.

Therefore, it will be understood that, in the above-mentioned conventional lever-joint type connecting structure, it is possible to fit the male connector in the fitting hood of the female connector by rotating the joint lever with low insertion force and ease.

In the above-mentioned lever-joint type connecting structure, however, it is impossible to confirm whether or not the male connector is fitted in the female connector perfectly by rotating the joint lever. Consequently, there has sometimes been a problem in that the male connector is fitted in the female connector imperfectly; in other words, the connectors are under a half-fitted condition. Thus, if the male and female connectors under such a condition, mounted on a vehicle, the male connector may be detached from the female connector by vibration or the like.

SUMMARY OF THE INVENTION

It is, therefore, an object of the present invention to provide a lever-joint type connecting structure by which it is possible for the operator to detect the fitting condition of male and female connectors, and thereby to prevent occurrence of a half-fitted condition in the connectors securely.

The object of the present invention described above can be accomplished by a lever-joint type connecting structure comprising:

a male connector having a first housing provided with a first terminal accommodating chamber in which a female terminal is accommodated;

a female connector having a fitting hood part for fitting the male connector therein and a second housing formed integral with the fitting hood part, the second housing having a terminal accommodating chamber in which a male terminal is accommodated for engagement with the female terminal;

a joint lever rotatably attached to either one of the male connector and the female connector, the joint lever having arc guide grooves formed so as to extend along a rotating direction of the joint lever;

projections formed on the other of the male connector and the female connector, the projections being adapted so as to fit the male connector into the female connector when the projections are inserted into the guide grooves and then guided therein, respectively, by a rotation of the joint lever; and a fit detecting member for detecting the fitting condition between the male connector and the female connector, the fit detecting member being arranged on either one of the male connector and the female connector so as to be engageable therewith both in a temporary engagement position and in a formal engagement position thereof;

wherein, in fitting the male connector into the female connector, the fit detecting member is released from its engaged condition in the temporary engagement position by a rotation of the joint lever; and wherein, in case that the fit detecting member is engaged in the formal engagement position, the fit detecting member operates to prevent the joint lever from being rotated.

With the arrangement mentioned above, the male connector is fitted into the female connector by rotating the joint lever arranged on either one of the male and female connectors while inserting the projections formed on the other one of the connectors into the guide grooves of the joint lever. By rotating the lever, the temporary engaged condition under which the fit detecting member is held in the temporary engagement position of the former connector can be released. Furthermore, by holding the fit detecting member in the formal engagement position, rotation of the joint lever can be prevented. Therefore, in fitting the male and female connectors to each other through the joint lever, if the above temporary engagement condition of the fit detecting member cannot be released by operating the lever, incomplete fitting of the male connector into the female connector can be detected. Furthermore, by holding the fit detecting member in the formal engagement position, it is possible to prevent the joint lever from being rotated unexpectedly.

In the present invention, preferably, the fit detecting member includes a locking part which is engageable with either one of the male connector and the female connector both in the temporary engagement position and in the formal engagement position thereof.

With the arrangement mentioned above, by rotating the joint lever, the engaged condition of the fit detecting member in the temporary engagement position can be released when the male connector has not been fitted into the female connector completely. Then, by holding the locking part of the fit detecting member in the formal engagement position, the rotation of the joint lever can be prevented. Therefore, in fitting the male and female connectors to each other through the joint lever, if the above engaged condition of the fit detecting member in the temporary engagement position cannot be released by operating the lever, incompleted insertion of the male connector into the female connector can be detected and, furthermore, by holding the fit detecting member in the formal engagement position, it is possible to prevent the joint lever from being rotated unexpectedly.

More preferably, the fit detecting member further includes a slide part which is adapted so as to fit with the joint lever after the male connector has been fitted into the female connector by the rotation of the joint lever, whereby formal engagement of the fit detecting member in the formal engagement position can be detested.

In this case, by rotating the joint lever while inserting the projections into the arc guide grooves of the joint lever, the male connector is fitted into the female connector. By rotating the joint lever, the engaged condition of the fit detecting member in the temporary engagement position will be released at the time when the male connector has not been fitted into the female connector yet. Thereafter, by fitting the slide part of the fit detecting member to the joint lever, the member is engaged in the formal engagement position.

Then, if it is impossible to fit the slide part to the joint lever, means that it is also impossible to release the fit detecting member from its engaged condition in the temporary engagement position by means of the joint lever, so that the fitting condition between the male and female connectors can be detected by the fit-detecting member.

In the present invention, preferably, the locking part comprises a flexible locking arm formed integral with the slide part and an engagement projection formed at a tip of the flexible locking part to engage with either one of the male connector and the female connector both in the temporary engagement position and in the formal engagement position, the engagement projection abutting a release part of the joint lever when the male connector is fitted into the female connector.

With the above arrangement, when the male and female connectors are connected with each other by rotating the joint lever, the release part of the lever is brought into contact with the engagement projection, so that the engagement projection is released from its engaged condition with the engagement part of the connector on one hand. Thereafter, the slide part is fitted into the joint lever. Consequently, the joint lever is maintained so as to be rotated toward the connector, with certainty. Then, if it is impossible to fit the slide part into the joint lever, this means that the joint lever is rotated insufficiently, whereby it can be detected that the engaged condition of the engagement projection to the engagement part has not been released yet.

It is also preferable that the joint lever be provided with a fitting groove into which the slide part is to be fitted on condition that the male connector is fitted into the female connector.

In this case, by fitting the slide part of the fit detecting member into the fitting groove after the male connector has been fitted into the female connector by rotating the lever, it is possible to prevent the joint lever from being rotated unexpectedly, whereby the joint lever can be maintained in position.

These and other objects and features of the present invention will become more fully apparent from the following description and appended claims taken in conjunction with the accompanied drawings.

DESCRIPTION OF THE PREFERRED EMBODIMENT

The connecting structure in accordance with an embodiment of the present invention will now be described in detail with reference to the drawings.

Figure 1:
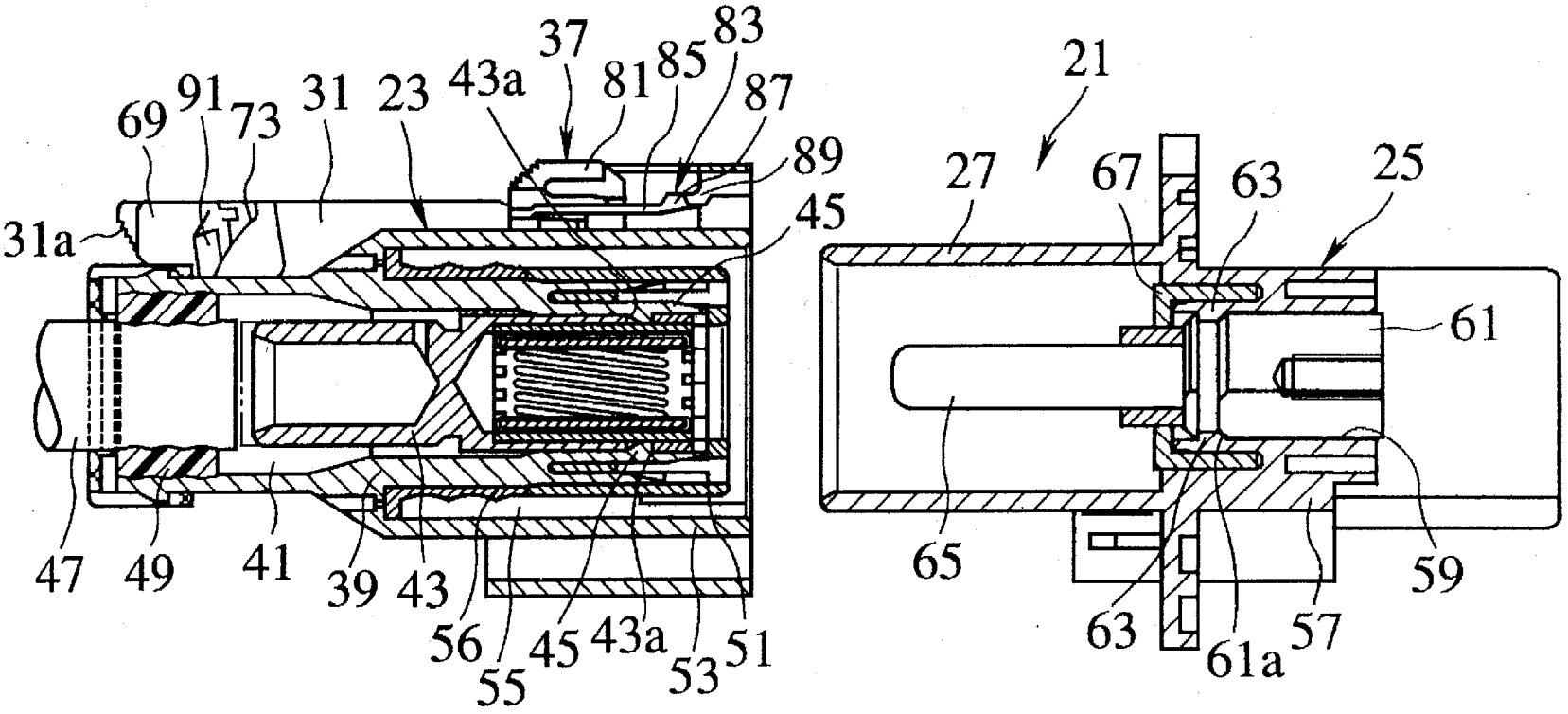
FIG. 1 is a cross sectional view of a lever-joint type connecting structure in accordance with the present invention, showing the interior of a male connector and that of a female connector before fitting to each other.
Figure 2:
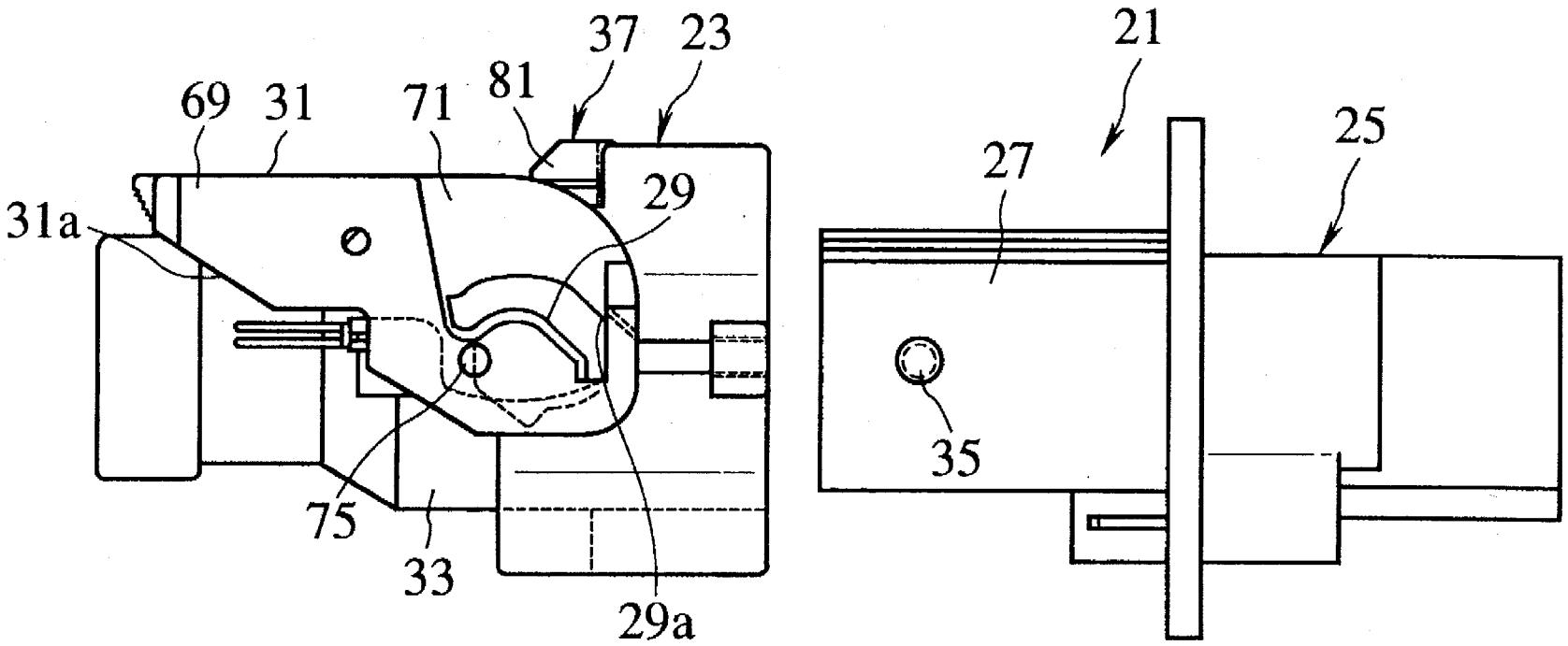
FIG. 2 is a side view of the lever-joint type connecting structure in accordance with the present invention, showing the male connector and the female connector before fitting to each other.
Figure 3:
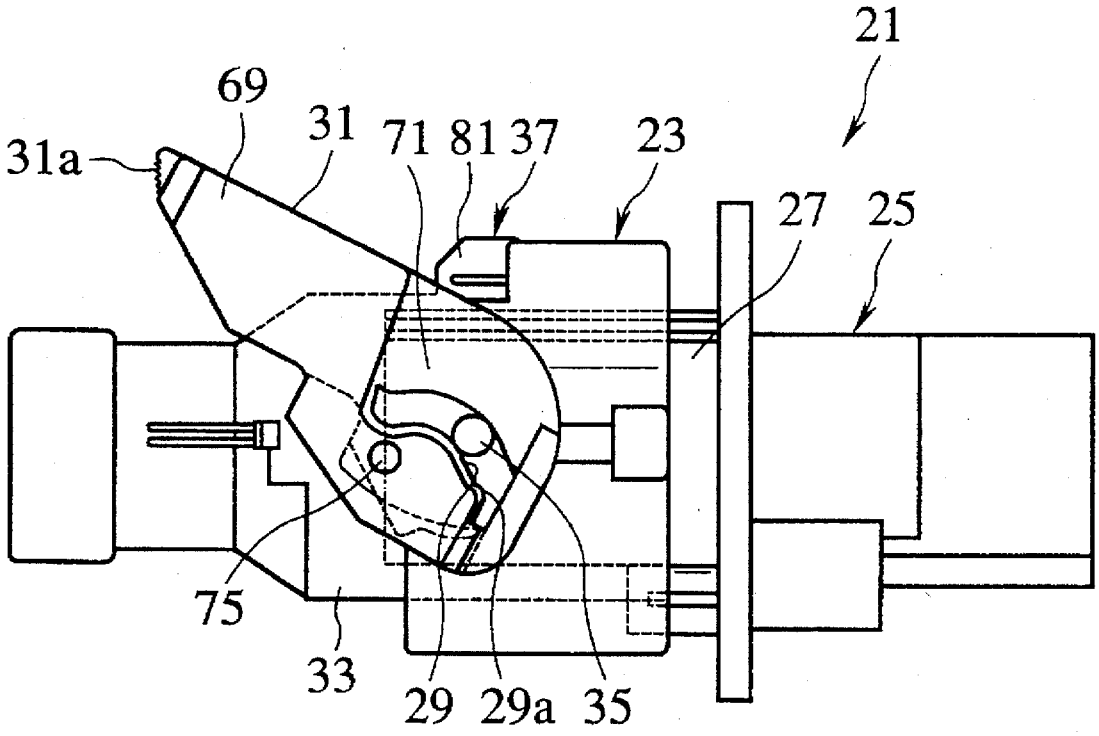
FIG. 3 is a side view of the lever-joint type connecting structure in accordance with the present invention, showing the male connector and the female connector in process of fitting to each other.
Figure 4:
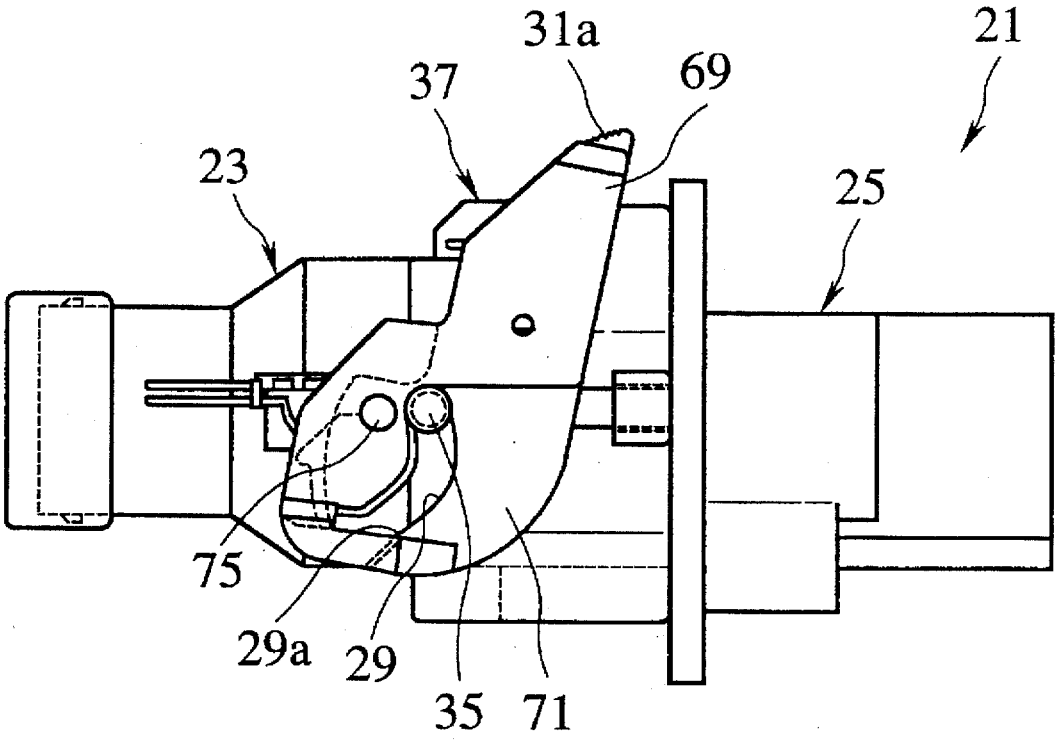
FIG. 4 is a side view of the lever-joint type connecting structure in accordance with the present invention, showing a condition that the male connector has been fitted into the female connector.
Figure 5:
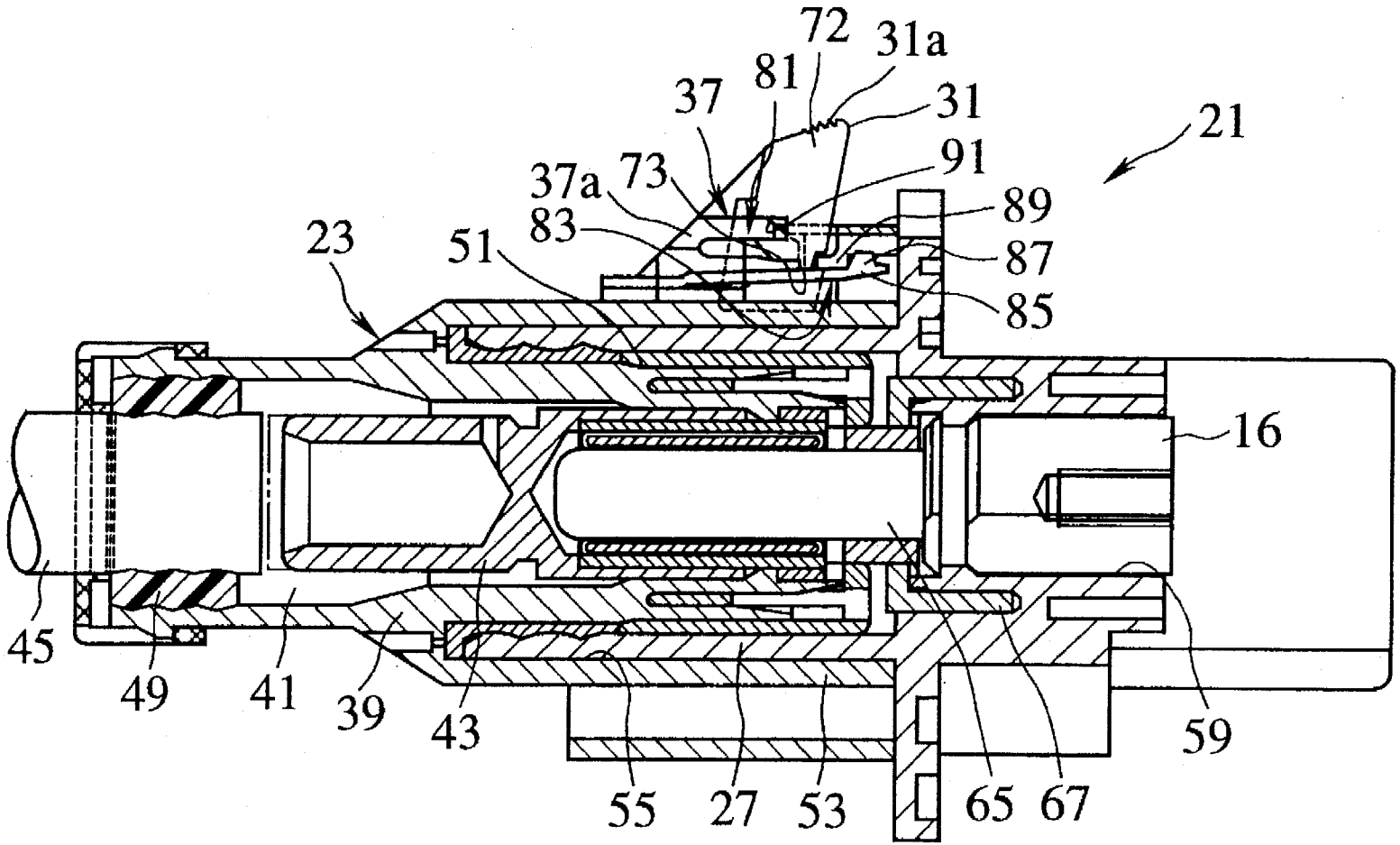
FIG. 5 is a cross sectional view of the lever-joint type connecting structure in accordance with the present invention, showing a condition that the male connector has been fitted into the female connector.

In the figures, FIG. 1 is a cross sectional view of a lever-joint type connecting structure 21, showing a male connector 23 and a female connector 25 which are not fitted to each other. FIGS. 2 to 4 are respective side views of the connecting structure 21, showing respective stages in the process of fitting the male connector 23 into the female connector 25. Further, FIG. 5 is a cross sectional view of the connecting structure 21, showing the interior structures of the male connector 23 and the female connector 25 under fitted condition.

As shown in FIGS. 1 and 2, the lever-joint type connecting structure 21 comprises the male connector 23, the female connector 25 having a fitting hood part 27 into which the male connector 23 is to be fitted, a joint lever 31 (see FIG. 2) rotatably attached to the male connector 23 and a pair of projections 35 formed on the female connector 25 laterally. The joint lever 31 has a pair of guide grooves 29 formed so as to extend along a rotating direction of the lever 31. Note, the projections 85 are guided by the guide grooves 29, respectively, when the male connector 23 is fitted into the fitting hood part 27.

According to the embodiment, the lever joint type connecting structure 21 further includes a member 37 arranged on the male connector 23 for detecting the fitting condition between the male connector 23 and the female connector 25. Note, in the specification, the member 37 will be referred to as "the fit detecting member 37", hereinafter. The fit detecting member 37 is held in a "temporary" engagement position in the male connector 23 when it has not yet been fitted in the female connector 25. On the other hand, when the male connector 23 and female connector 25 are engaged with each other, the fit detecting member 37 is released from its held condition at the temporary engagement position and then engaged in a "formal" engagement position, thereby to prevent the joint lever 31 from rotating.

The male connector 23 includes a housing 39 having a terminal accommodating chamber 41 formed therein for accommodating at least one female terminal 43. On an inner wall of the terminal accommodating chamber 41, a pair of flexible hook arms 45 are formed to project from opposing side walls of the chamber 41. The flexible hook arms 45 are provided with projecting steps which are to be engaged in engagement holes 43*a* formed in the female terminal 43, respectively. Therefore, it is possible to prevent the female terminal 43 from slipping out of the terminal accommodating chamber 41.

An electrical wire 47 is connected to an end of the female terminal 43. Inserted between the housing 39 and the wire 47 is a seal member 49 which serves to seal up a clearance defined between the inner wall of the chamber 41 and the outer periphery of the wire 47.

A front holder 51 is fitted into the housing 39. The front holder 51 is inserted into a bending space about the flexible hook arms 45 to prevent the female terminal 43 from slipping out of the terminal accommodating chamber 43. Furthermore, the male connector 23 includes an exterior wall 53 formed integral with the housing 39.

Formed between the exterior wall 53 and the housing 39 is a fitting recess 55 into which the fitting hood part 27 of the female connector 25 is to be fitted. In the fitting recess 55, a seal member 56 is fitted on the outer periphery of the housing 39. When the male connector 23 is fitted into the female connector 25, the seal member 56 serves to seal up a clearance between the housing 39 and the fitting hood part 27 of the female connector 25 in a leak-tight manner.

On the other hand, the female connector 25 has a housing 57 formed integral with the fitting hood part 27*a*. In the housing 57, a terminal accommodating chamber 59 is formed to accommodate at least one male terminal 61 therein. A flexible hook arm 63 is formed to project inwardly from the inner wall of the terminal accommodating chamber 59. The hook arms 63 are engaged in a peripheral groove 61*a* formed on the male terminal 61. Further, the male terminal 61 has a contact 65 projecting into the fitting hood part 27. On the side of the fitting hood part 27 in the female connector 25, a front holder 67 is fitted in the housing 57 and is inserted into a bending space of the flexible hook arms 63.

Under the condition that the male connector 23 is fitted into the female connector 25, the housing 39 of the male connector 23 is inserted into the fitting hood part 27 of the female connector 25, while the fitting hood part 27 is inserted into the fitting recess 55. Consequently, the contact 65 of the male terminal 61 is brought into contact with the female terminal 43, providing an electrical connection therebetween. Note, in this case, the male connector 23 and the female connector 25 are engaged with each other by rotating the joint lever 31.

The joint lever 31 consists of a control base 69 and a pair of supporting side walls (only one side wall 71 is shown in FIG. 2) extending from both sides of the control base 69, and providing a substantial C-shaped configuration.

We now describe the supporting side wall 71 on one side of the joint lever 31 representatively. The supporting side wall 71 is rotatably supported on the side wall 33 of the housing 39 of the male connector 28 through a pin 75. In addition, each supporting side wall 71 has an arc guide groove 29 formed to extend along a rotating direction of the joint lever 31. Inserted into the guide grooves 29 are projections 35 which respective formed to project from both side walls of the fitting hood part 27 of the female connector 25 in opposite directions. The joint lever 31 has a release part 73 formed on a joint wall 72 for connecting the supporting side walls 71, with each other. The joint wall 72 is further provided with a fitting groove 91.

By rotating the joint lever 31 from the un-fitted position of FIG. 3, where a tip opening 29*a* of the guide groove 29 is positioned close to the fitting part of the male connector 23, up to the fitted position of FIG. 4, where the tip opening 29*a* has been brought underside of the male connector 23, the projections 35 can be guided into the inmost parts of the guide grooves 29. When the projections 35 are guided into the inmost parts of the guide grooves 29, the fitting hood part 27 is inserted into the fitting recess 55, while the contact 65 of the male terminal 61 is fitted into the female terminal 43. When the joint lever 31 is rotated to reach the fitted position, the fit detecting member 37 is released from its engaged condition in the temporary engagement position.

Figure 6A:
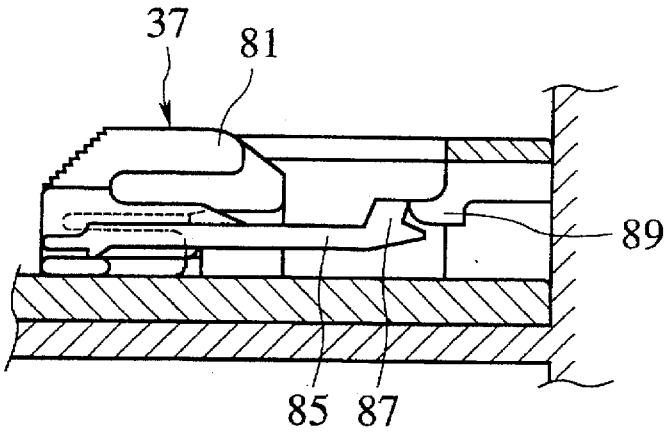
FIG. 6A is a partial cross sectional view of the lever-joint type connecting structure of the present invention, in which a fit detecting member is engaged in a temporary engagement position.

As shown in FIGS. 5 and 6A, the fit detecting member 37 is slidably engaged with the outside of the outer wall 53. The fit detecting member 37 comprises a slide part 81 and a locking part 83. The locking part 83 is composed of a flexible locking arm 85 and an engagement projection 87 formed at a tip of the locking arm 85. Since the projection 87 engages with a tip of an engagement part 89 arranged on the outside of the outer wall 53, the fit detecting member 37 is held in the temporary engagement position. Further, the fit detecting member 37 can also be held in the formal engagement position by engaging the projection 87 with the inmost part of the engagement part 89.

When the joint lever 31 is further rotated to the fitted position, the release part 73 of the joint lever 31 comes into contact with the top face of the projection 87, so that the locking arm 87 is bent downwardly. Consequently, since the projection 87 is disengaged from the tip of the engagement part 89, the fit detecting member 87 is released from its temporary engaged condition so as to be movable to the formal engagement position.

Figure 6B:
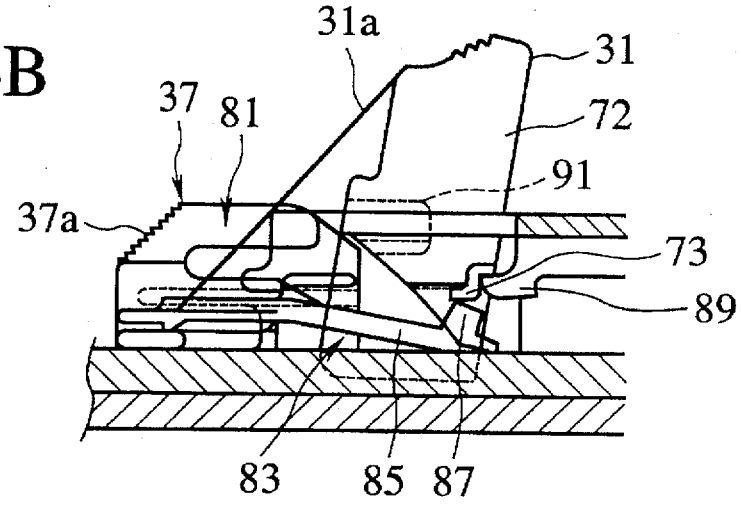
FIG. 6B is a partial cross sectional view of the lever-joint type connecting structure of the present invention, in which the fit detecting member has been released from its temporary engaged condition by the joint lever.
Figure 6C:
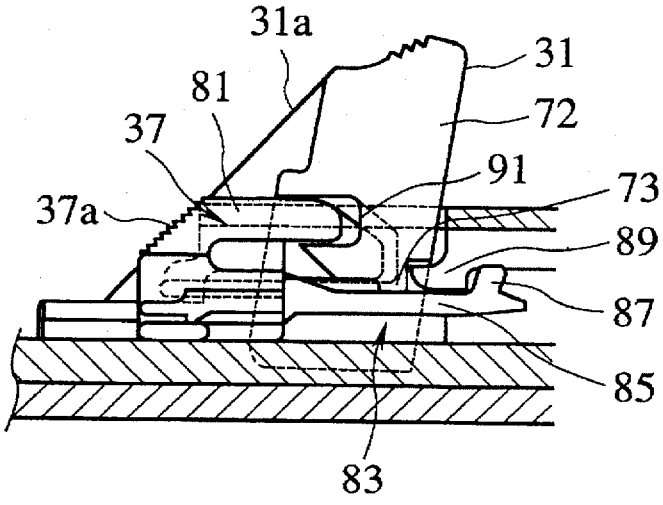
FIG. 6C is a partial cross sectional view of the lever-joint type connecting structure of the present invention, in which the fit detecting member has been engaged in a formal engagement position.

When the fit detecting member 37 is moved to the formal engagement position, the slide part 81 is also slid and fitted into the fitting groove 91 formed in the joint lever 31. As shown in FIG. 6B, when the engagement projection 87 engages with the utmost area of the engagement part 89, the joint lever 31 and the fit detecting member 37 are arranged so that an operating face 31*a* of the lever 31 and an operating face 37*a* of the fit detecting member 87 are in one plane. Under such a condition, if the fit detecting member 37 can be held in the formal engagement position, it can be detected by the operator that the male connector 23 is now fitted into the female connector 25 completely, while the joint lever 31 can be held in the fitted position.

We now describe how to fit the male connector 23 and the female connector 25 to each other.

First of all, the housing 39 of the male connector 23 is inserted into the fitting hood part 27 on condition that the openings 29*a* of the guide grooves 20 of the joint lever 31 are arranged so as to oppose the fitting side of the connector 23. Then, the projections 35 are inserted into the guide grooves 29. It is noted that, in this state, the fit detecting member 37 is held in the temporary engagement position of the male connector 23 as shown in FIG. 6A. Next, as shown in FIG. 3, the projections 35 are inserted into the guide grooves 29 by rotating the joint lever 31. Consequently, the fitting hood part 27 is fitted into the fitting recess 55, so that the contact 65 of the male terminal 61 is fitted into the female terminal 43. Then, the projections 35 are guided into the inmost part of the guide grooves 29 by rotating the joint lever 31 to the fitted position, as shown in FIGS. 4 and 5.

As shown in FIG. 6B, the rotation of the joint lever 31 up to the fitted position allows the release part 73 of the lever 31 to abut on the top face of the engagement projection 87, so that the locking arm 85 is bent downwardly to cancel the engagement relationship between the projection 87 and the engagement part 89. That is, the fit detecting member 37 is released from its temporary engaged condition.

Next, the fit detecting member 37 is slid toward the female connector 25. Consequently, the slide part 81 is fitted into the fitting groove 91 while the engagement projection 87 engages with the inmost part beyond the engagement part 89.

Owing to the engagement of the projection 87 with the inmost part beyond the engagement part 89, the operating face of the fit detecting member 37 and the operating face 31*a* of the joint lever 31 are brought into one plane, while the fit detecting member 37 serves to hold the joint lever 31 in the formal engagement position. Consequently, the male connector 23 can be fitted into the female connector 25 completely. In addition, it is possible to prevent the joint lever 31 from being rotated, so that the complete fitting condition between the male connector 23 and the female connector 25 can be maintained.

Meanwhile, if the joint lever 31 is not rotated completely, it means that it is impossible to fit the slide part 81 of the fit detecting member 87 into the fitting groove 91. Because it is impossible to bend the locking arm 85 downwardly, the engagement between the engagement projection 87 and the engagement part 89 cannot be released. Accordingly, it will be possible easily for the operator to detect the incomplete fitting condition between the male connector 23 and the female connector 25.

As mentioned above, according to the embodiment, by shifting the fit detecting member 37 from the temporary engagement position to the formal engagement position after the joint lever 31 has been rotated, it is easily possible to detect the fitting condition between the male connector 23 and the female connector 25, so that the incomplete fitting between the male connector 23 and the female connector 25 can be prevented certainly.

Under the condition that the fit detecting member 37 is engaged in the formal engagement position, since there is no possibility that the joint lever 31 can be rotated unexpectedly, the engagement force between the male connector 23 and the female connector 25 can be increased.

According to the embodiment, owing to the provision of the fit detecting member 37, it is possible to reduce the whole cost in manufacturing the connecting structure in comparison with a case of manufacturing a conventional connecting structure which requires a separate jig for detecting the fitting condition.

Although the joint lever 31 is arranged on the male connector 23 while the projections 35 are formed on the female connector 25 in the above-mentioned embodiment, the present invention may be applicable to another connecting structure where the joint lever is arranged on the female connector while the projections are formed on the male connector. In such a case, the fit detecting member would engage with the female connector both in the temporary engagement position and in the formal engagement position.

Finally, it will be understood by those skilled in the art that the foregoing description is one of preferred embodiments of the disclosed connecting structure, and that various changes and modifications may be made without departing from the spirit and scope thereof.

What is claimed is:

1. A lever-joint type connecting structure, comprising:

a male connector having a first housing provided with a first terminal accommodating chamber in which a female terminal is accommodated;

a female connector having a fitting hood part for fitting said male connector therein and a second housing formed integral with said fitting hood part, said second housing having a terminal accommodating chamber in which a male terminal for engagement with said female terminal is accommodated;

a joint lever rotatably attached to one of said male connector and said female connector, said joint lever having arc guide grooves formed so as to extend along a rotating direction of said joint lever;

projections formed on the other of said male connector and said female connector, said projections being adapted for insertion into said guide grooves, respectively, by a rotation of said joint lever so as to fit said male connector into said female connector; and fit detecting member means for detecting a fitting condition between said male connector and said female connector, said fit detecting member means being arranged on one of said male connector and said female connector so as to be engageable therewith both in a temporary engagement position and in a formal engagement position thereof;

wherein, in fitting said male connector into said female connector, said fit detecting member means is released from an engaged condition in the temporary engagement position by a rotation of said joint lever; and wherein, when said fit detecting member means is in the formal engagement position, said fit detecting member means operates to prevent said joint lever from being rotated.

2. A lever-joint type connecting structure as claimed in claim 1, wherein said fit detecting member means includes a locking part which is engageable with one of said male connector and said female connector both in the temporary engagement position and in the formal engagement position thereof.

3. A lever-joint type connecting structure as claimed in claim 1, wherein said fit detecting member means includes a slide part which is adapted to fit with said joint lever after said male connector has been fitted into said female connector by the rotation of said joint lever, whereby it can be detected that said fit detecting member means is engaged formally in the formal engagement position.

4. A lever-joint type connecting structure as claimed in claim 3, wherein said joint lever is provided with a fitting groove into which said slide part fits on condition that said male connector is fitted into said female connector.

5. A lever-joint type connecting structure as claimed in claim 2, wherein said fit detecting member means further includes a slide part which is adapted to fit with said joint lever after said male connector has been fitted into said female connector by the rotation of said joint lever, whereby it can be detected that said fit detecting member means is engaged formally in the formal engagement position.

6. A lever-joint type connecting structure as claimed in claim 5, wherein said locking part comprises a flexible locking arm formed integral with said slide part and an engagement projection formed at a tip of said flexible locking arm to engage with one of said male connector and said female connector both in the temporary engagement position and in the formal engagement position, said engagement projection abutting a release part of said joint lever when said male connector is fitted into said female connector.

7. A lever-joint type connecting structure as claimed in claim 6, wherein said joint lever is provided with a fitting groove into which said slide part fits on condition that said male connector is fitted into said female connector.

8. A lever-joint type connecting structure as claimed in claim 5, wherein said joint lever is provided with a fitting groove into which said slide part fits on condition that said male connector is fitted into said female connector.

9. A lever-joint type connecting structure, comprising:

a male connector having a first housing provided with a first terminal accommodating chamber in which a female terminal is accommodated;

a female connector having a fitting hood part for fitting said male connector therein and a second housing formed integral with said fitting hood part, said second housing having a terminal accommodating chamber in which a male terminal for engagement with said female terminal is accommodated;

a joint lever rotatably attached to one of said male connector and said female connector, said joint lever having arc guide grooves formed so as to extend along a rotating direction of said joint lever;

projections formed on the other of said male connector and said female connector, said projections being adapted for insertion into said guide grooves, respectively, by a rotation of said joint lever so as to fit said male connector into said female connector; and fit detecting member means for detecting a fitting condition between said male connector and said female connector, said fit detecting member means being arranged on one of said male connector and said female connector so as to be engageable therewith both in a temporary engagement position and in a formal engagement position thereof;

wherein said fit detecting member means includes a locking part which is engageable with one of said male connector and said female connector both in the temporary engagement position and in the formal engagement position thereof.

10. A lever-joint type connecting structure as claimed in claim 9, wherein said fit detecting member means includes a slide part which is adapted to fit with said joint lever after said male connector has been fitted into said female connector by the rotation of said joint lever, whereby it can be detected that said fit detecting member means is engaged formally in the formal engagement position.

11. A lever-joint type connecting structure as claimed in claim 10, wherein said locking part comprises a flexible locking arm formed integral with said slide part and an engagement projection formed at a tip of said flexible locking arm to engage with one of said male connector and said female connector both in the temporary engagement position and in the formal engagement position, said engagement projection abutting a release part of said joint lever when said male connector is fitted into said female connector.

12. A lever-joint type connecting structure as claimed in claim 11, wherein said joint lever is provided with a fitting groove into which said slide part fits on condition that said male connector is fitted into said female connector.

13. A lever-joint type connecting structure, comprising:

a male connector having a first housing provided with a first terminal accommodating chamber in which a female terminal is accommodated;

a female connector having a fitting hood part for fitting said male connector therein and a second housing formed integral with said fitting hood part, said second housing having a terminal accommodating chamber in which a male terminal for engagement with said female terminal is accommodated;

a joint lever rotatably attached to one of said male connector and said female connector, said joint lever having arc guide grooves formed so as to extend along a rotating direction of said joint lever;

projections formed on the other of said male connector and said female connector, said projections being adapted for insertion into said guide grooves, respectively, by a rotation of said joint lever so as to fit said male connector into said female connector; and fit detecting member means for detecting a fitting condition between said male connector and said female connector, said fit detecting member means being arranged on one of said male connector and said female connector so as to be engageable therewith both in a temporary engagement position and in a formal engagement position thereof;

wherein said fit detecting member means includes a slide part which is adapted to fit with said joint lever after said male connector has been fitted into said female connector by the rotation of said joint lever, whereby it can be detected that said fit detecting member means is engaged formally in the formal engagement position.

14. A lever-joint type connecting structure as claimed in claim 13, wherein said joint lever is provided with a fitting groove into which said slide part fits on condition that said male connector is fitted into said female connector.

* * * * *